US006644841B2

(12) United States Patent
Martineau

(10) Patent No.: US 6,644,841 B2
(45) Date of Patent: Nov. 11, 2003

(54) LIGHT EMITTING DIODE REFLECTOR

(75) Inventor: Patrick M. Martineau, Montreal (CA)

(73) Assignee: Gelcore LLC, Valley View, OH (US)

( * ) Notice: Subject to any disclaimer, the term of this patent is extended or adjusted under 35 U.S.C. 154(b) by 0 days.

(21) Appl. No.: 10/159,252

(22) Filed: May 31, 2002

(65) Prior Publication Data

US 2003/0165061 A1 Sep. 4, 2003

Related U.S. Application Data

(60) Provisional application No. 60/361,140, filed on Mar. 1, 2002.

(51) Int. Cl.[7] ..... F21V 101/02

(52) U.S. Cl. ..... 362/545; 362/517; 362/800; 362/297; 362/346; 362/241

(58) Field of Search ..... 362/800, 545, 362/546, 517, 518, 297, 310, 346, 237, 241, 238, 240

(56) References Cited

U.S. PATENT DOCUMENTS 4,733,335 A * 3/1988 Serizawa et al. ..... 362/80
5,580,156 A * 12/1996 Suzuki et al. ..... 362/184
5,723,868 A * 3/1998 Hammond et al. ..... 250/553
6,296,376 B1 * 10/2001 Kondo et al. ..... 362/310
6,547,416 B2 * 4/2003 Pashley ..... 362/231
D474,303 S * 5/2003 Huang ..... D26/123
6,573,653 B1 * 6/2003 Ishinaga ..... 313/512

* cited by examiner

*Primary Examiner*—Laura K. Tso
(74) *Attorney, Agent, or Firm*—Orum & Roth

(57) ABSTRACT

A reflector for use with light emitting devices. Multiple reflective surfaces redirect light emission components of the light emitting device, for example a light emitting diode, into a desired direction. The different light emission components including a total internal reflection light emission component. Paired light emitting devices share common reflector surfaces creating an oval light pattern. Holes in the reflector accommodate electrical components and enhance heat dissipation. A deflector pattern on non-reflector surfaces minimizes sun phantom effect when the reflector is used, for example, in a traffic signal.

20 Claims, 14 Drawing Sheets

LIGHT EMITTING DIODE REFLECTOR

This application claims the benefit of U.S. Provisional patent application No. 60/361,140 filed Mar. 1, 2002, hereby incorporated by reference in the entirety.

BACKGROUND OF THE INVENTION

1. Field of the Invention

The present invention relates to a reflector for collecting and redirecting light from a light source. Specifically, the invention relates to a reflector usable with, for example, a standard light emitting diode (LED) package utilizing an epoxy housing with a top facing lens.

2. Description of the Related Art

The ability to maximize light output from a light source increases energy efficiency and reduces manufacturing cost. By minimizing light losses, i.e. light rays not directed into the desired light pattern, all the light generated by a signal may be used. Maximizing a signals light output in the desired light pattern minimizes the number of and power level required for light emitting devices that would otherwise be needed to overcome light losses previously accepted as a design loss.

As shown in FIG. 1, standard light emitting diodes utilize an epoxy housing wherein a LED die 1 is located. When current is applied, the die activates and emits light. The light is reflected upward by one of the leads 15 which is in the form of a cup 20. The majority of the light is directed out of the top of the housing 10 through a lens 5 which directs it in a conical distribution pattern with an angle, in a standard LED, of approximately 20 to 30 degrees. FIG. 2 shows a typical light distribution emitted by a light emitting diode. The majority of light is projected forward in the desired direction but a large percentage (40–50%) is directed in other directions and is therefore treated as a design loss in most applications.

The light distribution shown in FIG. 2, may be categorized into three components. As shown in FIG. 3, the main component of the LED light is directed vertically through the lens 5. However, a second component is not directed into the lens 5 but instead escapes out of the side of the housing 10 at an increased spreading angle to the vertical axis of the housing 10 as shown in FIG. 4. A third component of the light is subject to total internal reflection within the housing from which it exits at an increased angle as shown in FIG. 5.

Previous reflectors used with LEDs attempted to collect and redirect sideways emitted light but did not account for the light subject to total internal reflection, effectively wasting this component of the LED light output. It is an object of the present invention to provide an energy efficiency maximizing LED reflector which, in addition to redirecting sideways emitted LED light, also redirects the light rays subject to total internal reflection, thereby maximizing light output for an individual or cluster of LEDs.

SUMMARY OF THE INVENTION

The present invention provides a reflector for individual or groups of light emitting devices, for example LEDs. Redirecting light normally escaping through the side of an LED package, the reflector also redirects light that reflects under total internal reflection conditions within the LED housing. A second reflection surface of the reflector is aligned with the increased exit angle of the total internal reflection light component. Because the angle is higher than that of light escaping sideways from the LED housing, the second reflector surface appears as a step back in the first reflection surface and does not degrade the first surface's ability to redirect the sideways escaping light component. Pairing light emitting devices in a shared reflector configuration with a light deflecting pattern on non-reflector surface areas of the reflector creates an oval light pattern with reduced sun phantom properties useful for creating traffic signals according to Institute of Traffic Engineers (ITE) specifications.

DETAILED DESCRIPTION

Figure 1:
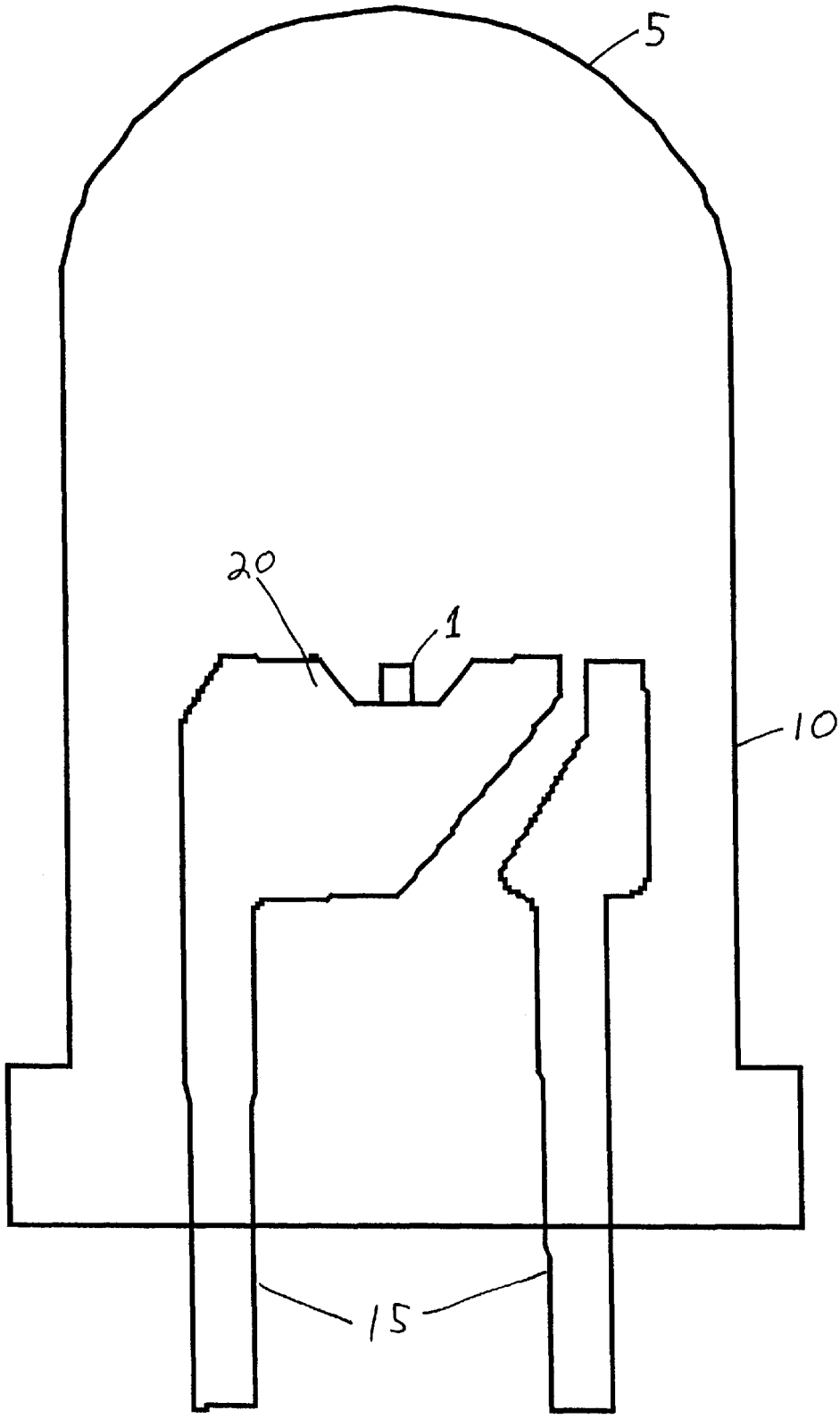
FIG. 1 is a cutaway side view of a typical LED package.
Figure 2:
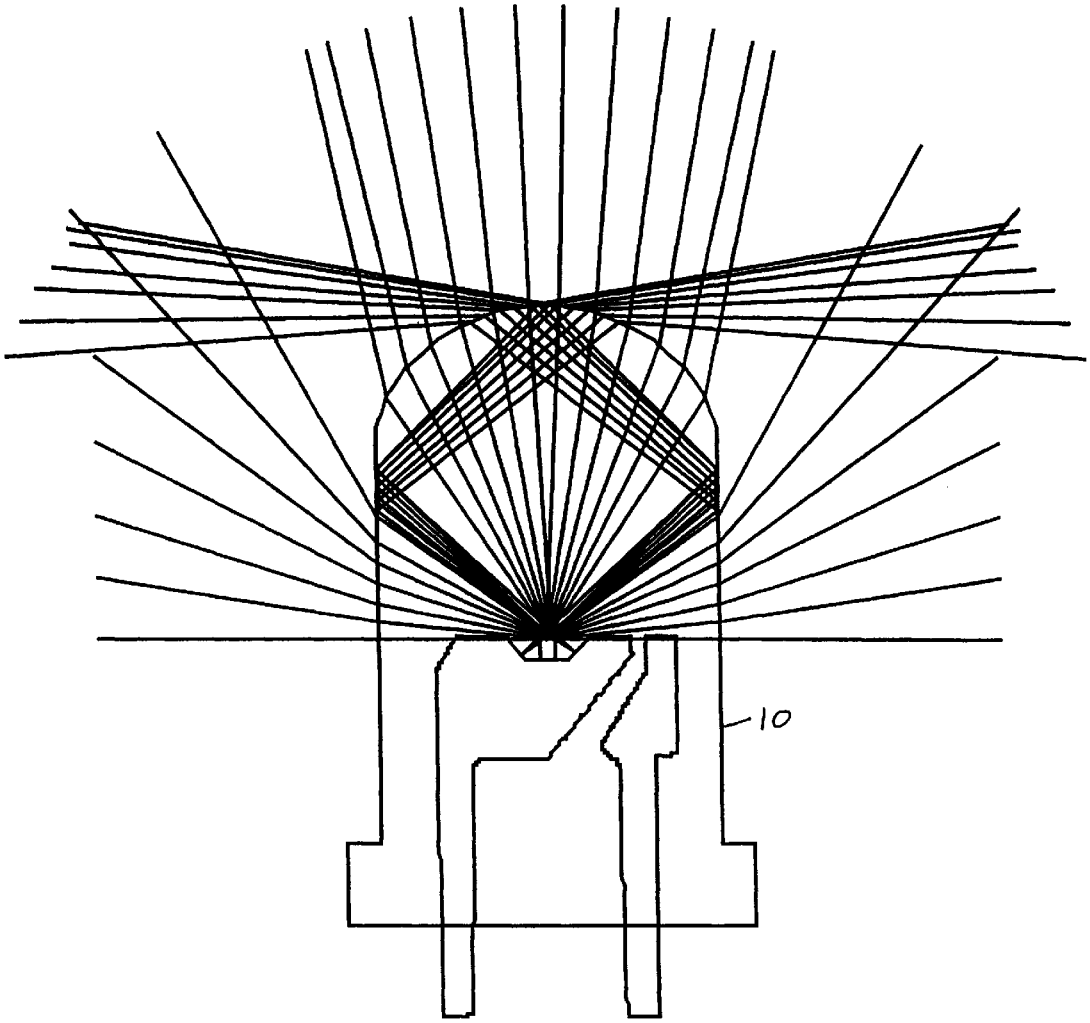
FIG. 2 is a light ray diagram showing the light emission pattern of a typical LED.
Figure 3:
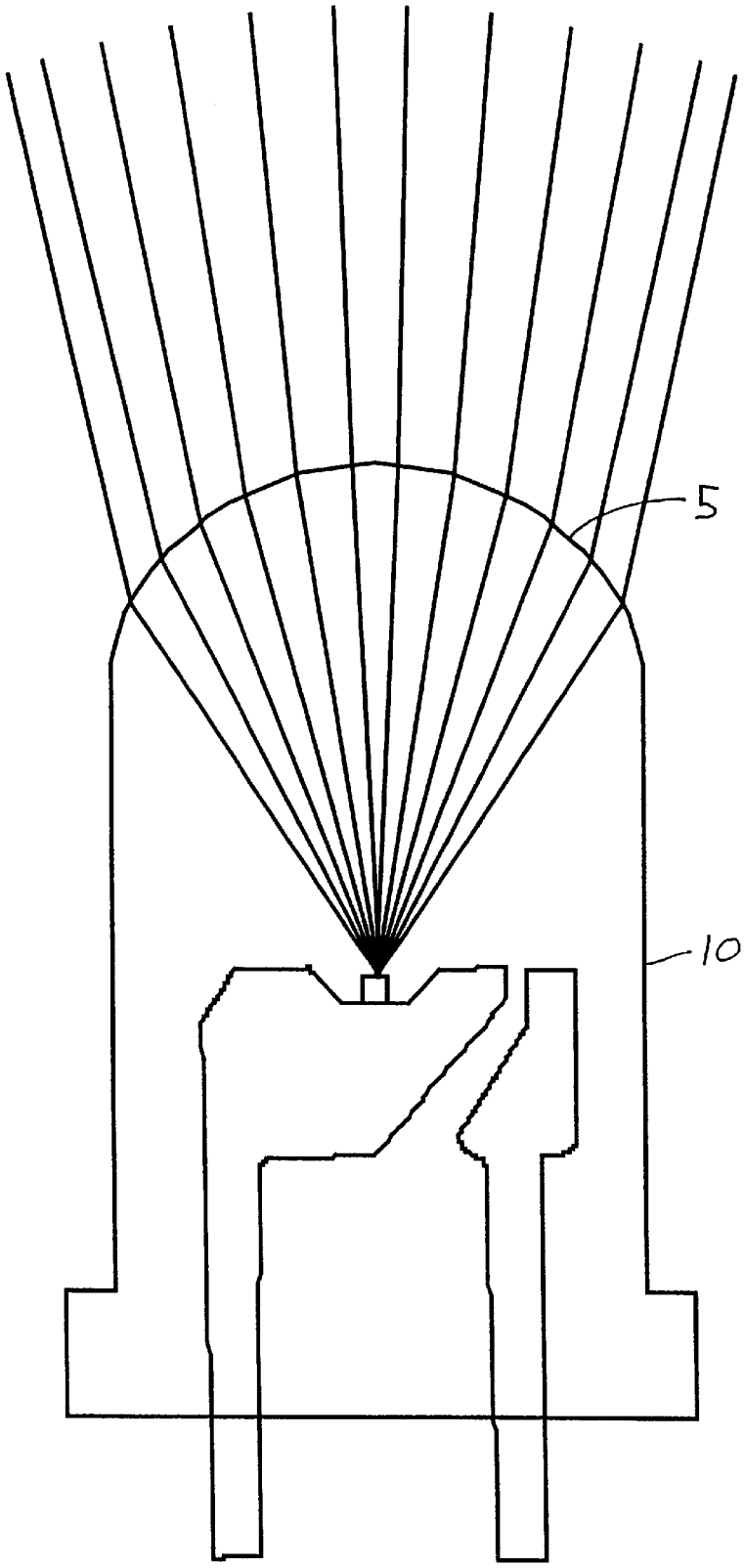
FIG. 3 is a light ray diagram showing the light component of FIG. 2 that is forward projected via the LED lens.
Figure 4:
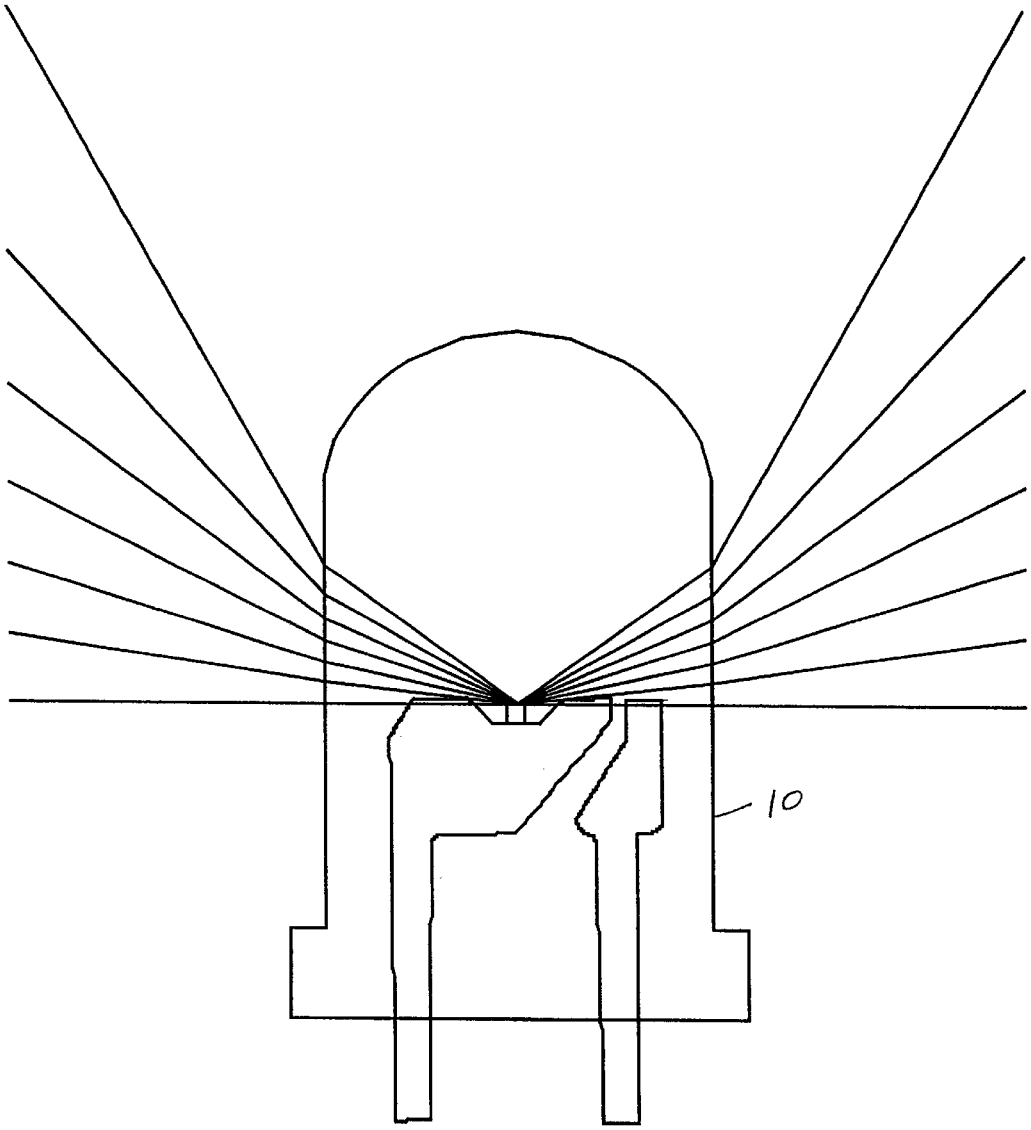
FIG. 4 is a light ray diagram showing the light component of FIG. 2 that is escaping via the side of the LED housing.
Figure 5:
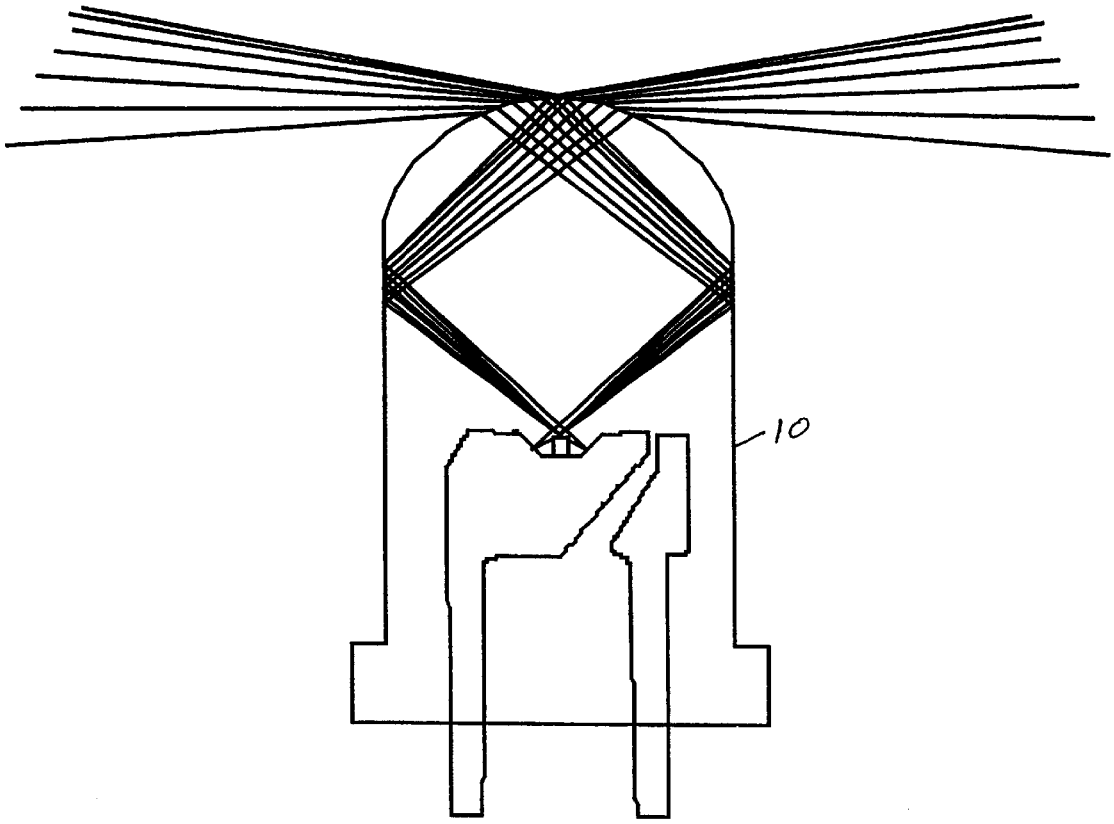
FIG. 5 is a light ray diagram showing the light component of FIG. 2 that is subject to total internal reflection.
Figure 6:
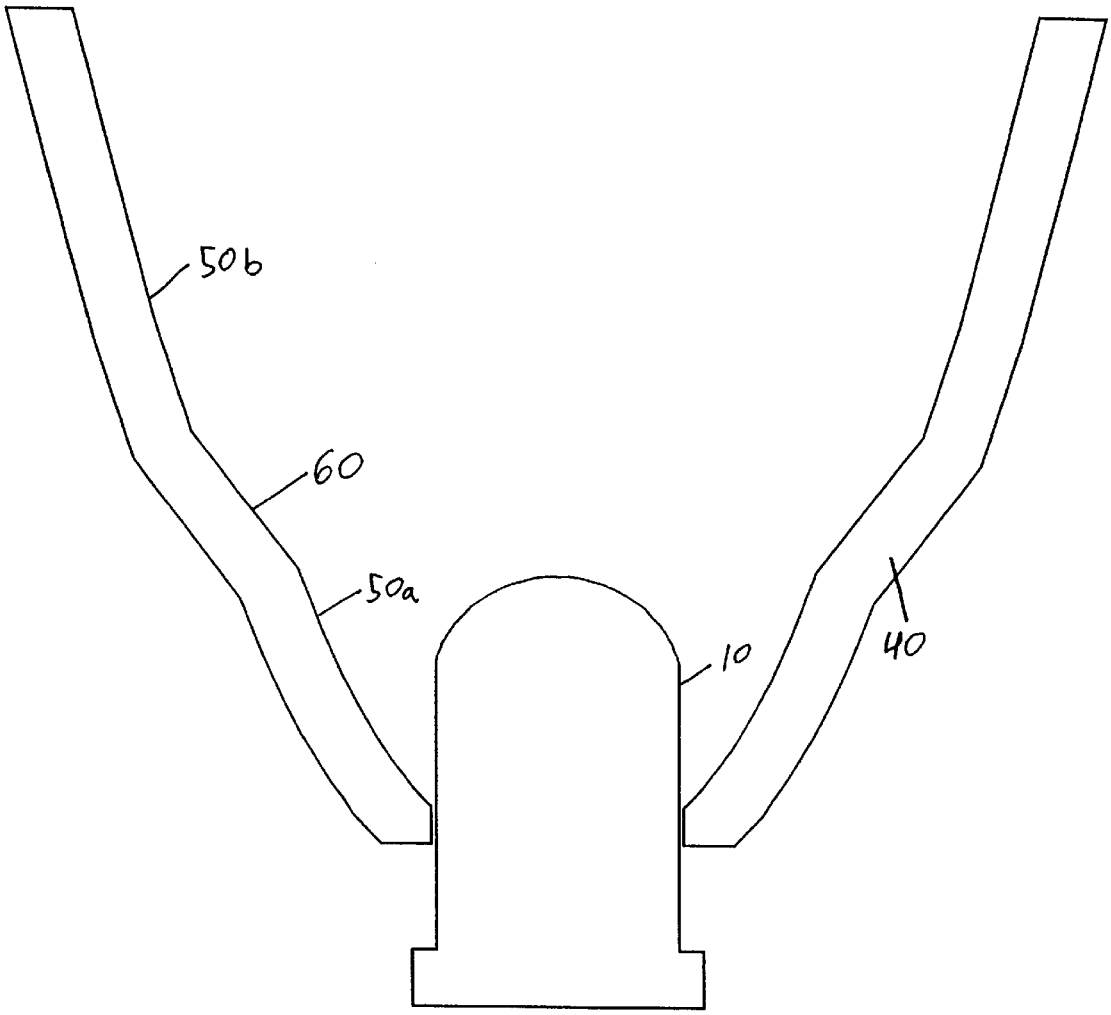
FIG. 6 is a cutaway side view of a light emitting diode with a reflector according to one embodiment of the invention.
Figure 9:
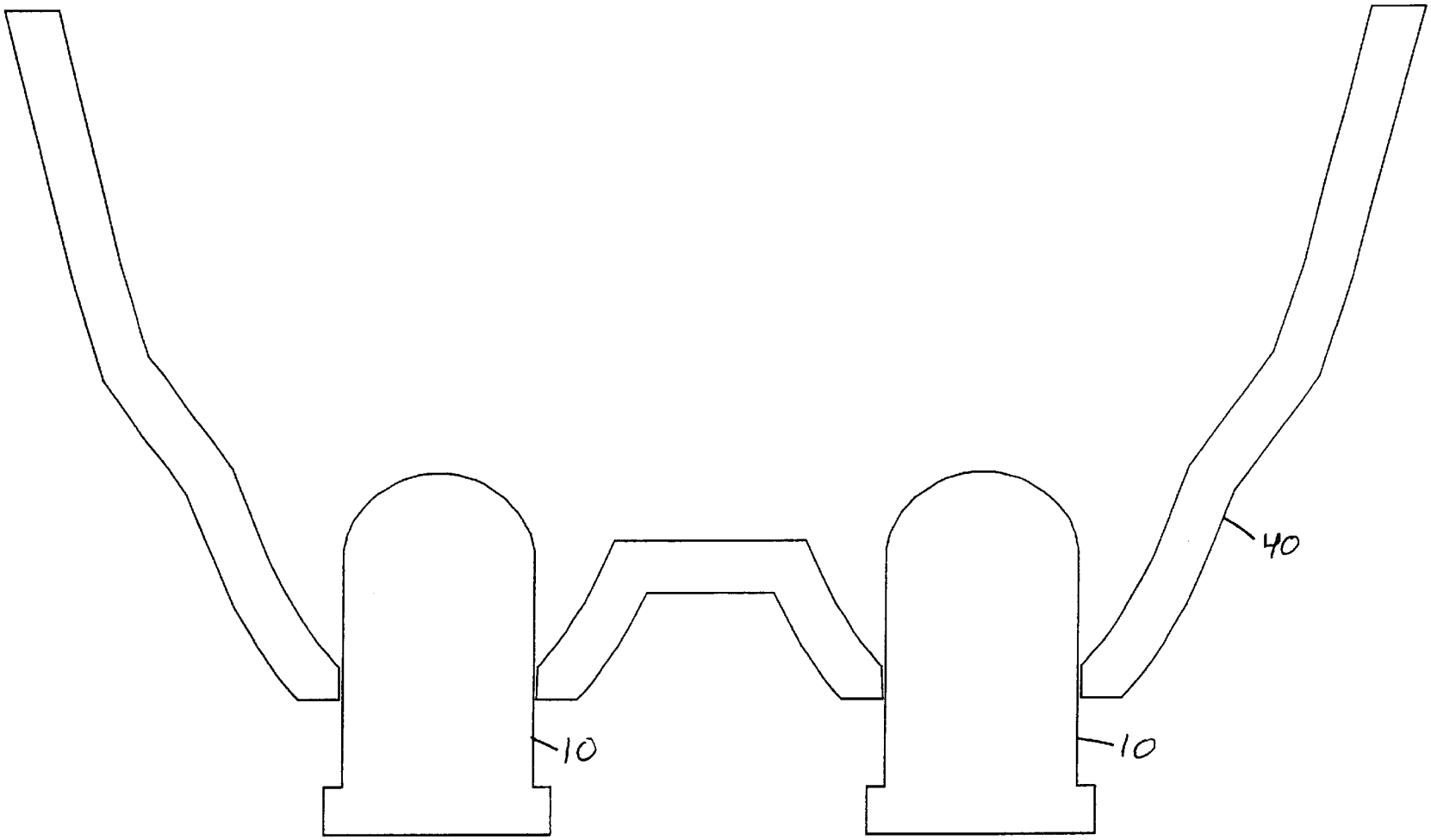
FIG. 9 is a cutaway side view of a multiple LED reflector embodiment according to the present invention.
Figure 10:
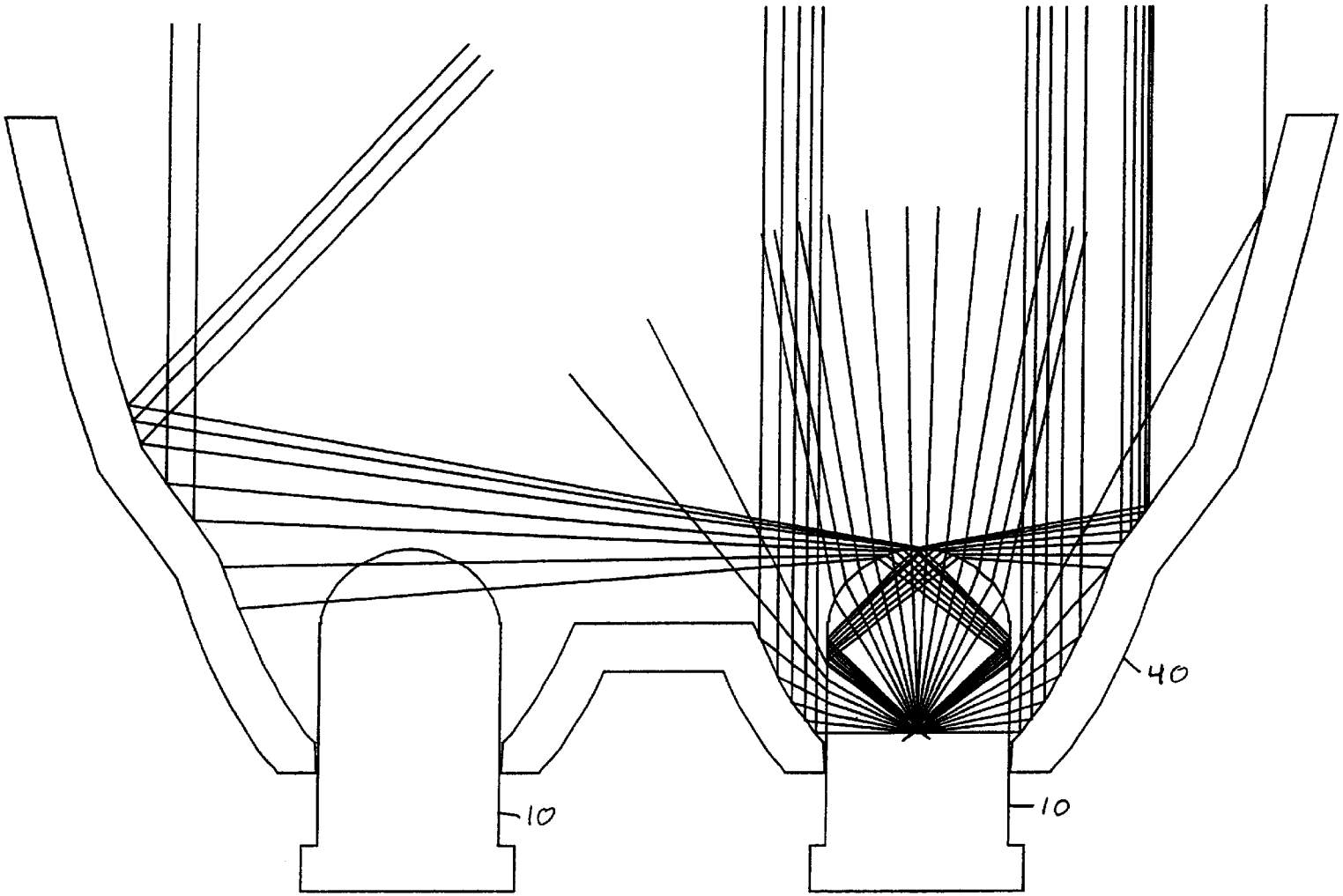
FIG. 10 is a ray diagram showing the effect of the reflector of FIG. 9 on the light emission pattern of an LED.
Figure 11:
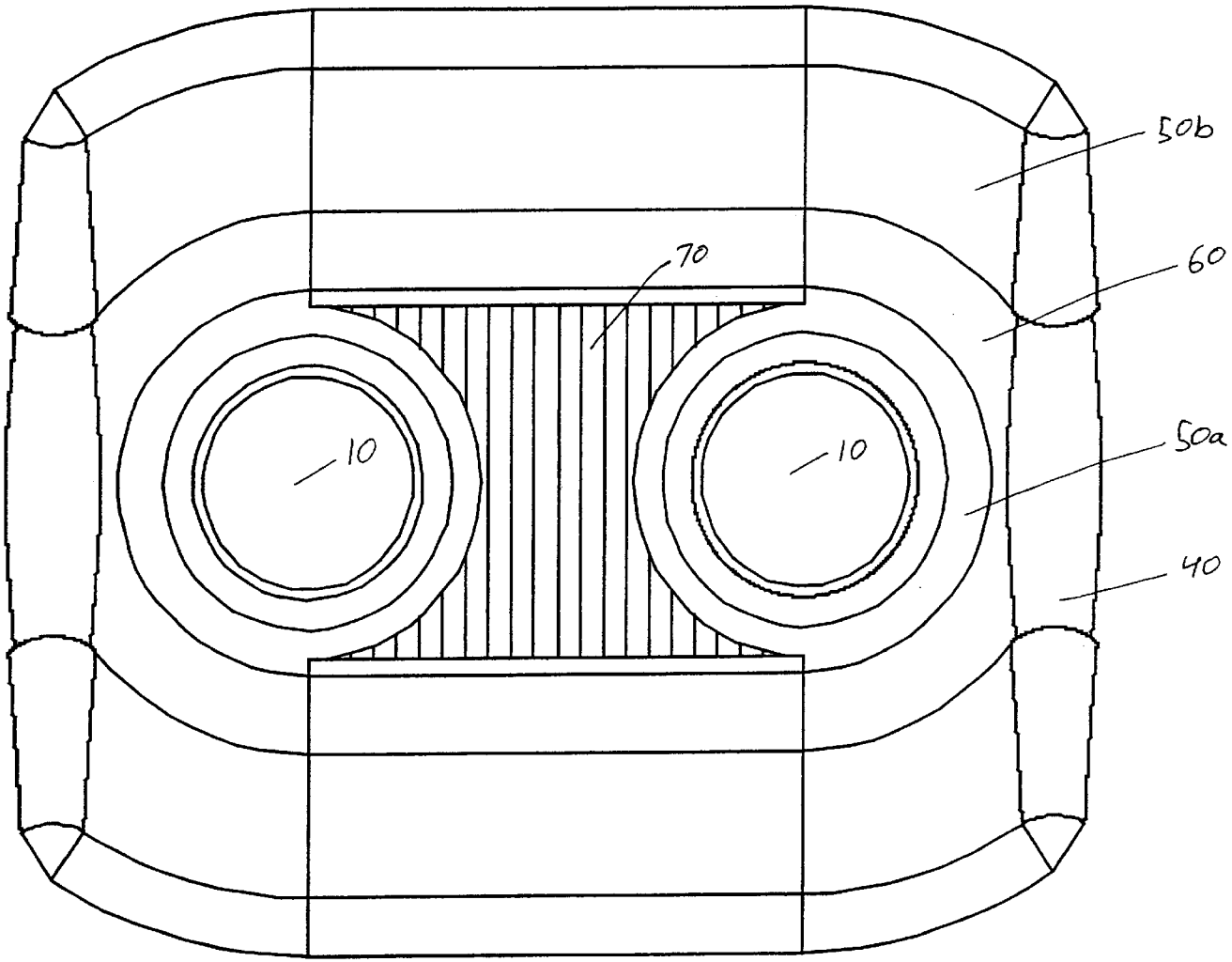
FIG. 11 is a top view of a paired LED reflector embodiment, showing a sun phantom deflection surface on non-reflector surface area between paired LEDs.

A reflector 40 as shown in FIGS. 6, 9 and 11 fits over the LED housing(s) 10. The reflector 40 has a reflective coating on its inner surface. The reflector 40 may be plastic, for example, with a chrome coating and/or be formed using aluminum or other metallic material with a reflective coating or polished reflective surface.

Figure 12:
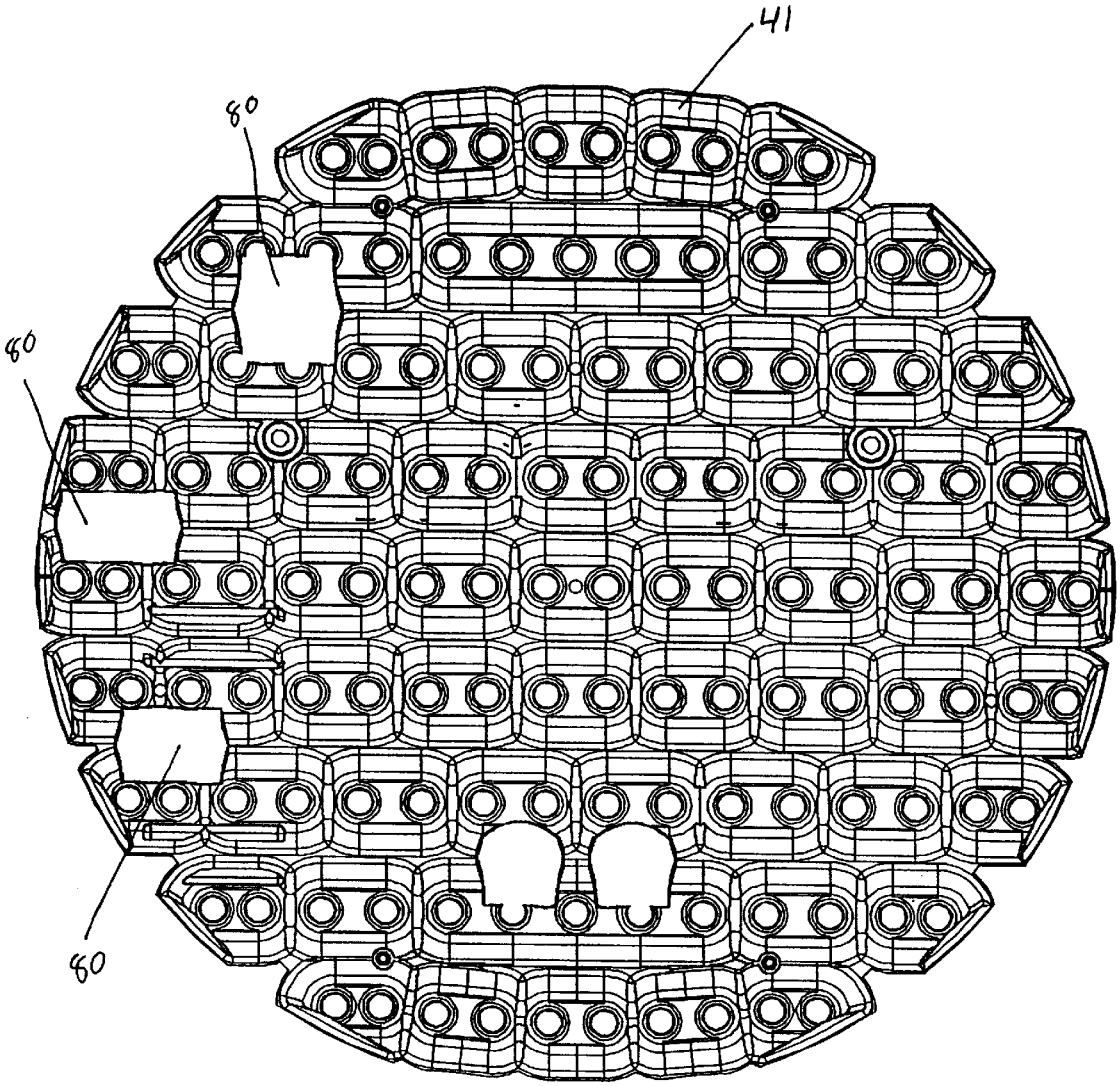
FIG. 12 is a top view of a reflector for a matrix of LEDs.

When aluminum or other heat conducting metal/material is used as the reflector material, the reflector itself may also function as a heat sink. To further increase heat dissipation away from the PCB or specific heat generating electrical components mounted on the PCB and the LED's themselves, holes may be formed in areas between the reflective surfaces of different LEDs, as shown in FIG. 12. Holes may also be formed to accommodate electrical components that are oversize and would otherwise interfere with mounting of the reflector with respect to the LEDs.

The reflector 40 has a first surface 50*a* configured to reflect light emitted sideways through the LED housing. A second surface 60 reflects light subject to total internal reflection within the LED housing 10. A third surface 50*b* is configured to also reflect light escaping on the side of the LED housing. As the angle of the second surface 60 is higher than that of either 50*a* or 50*b* the step back that it creates does not cause any loss with respect to the sideways emitted LED light component.

Figure 7:
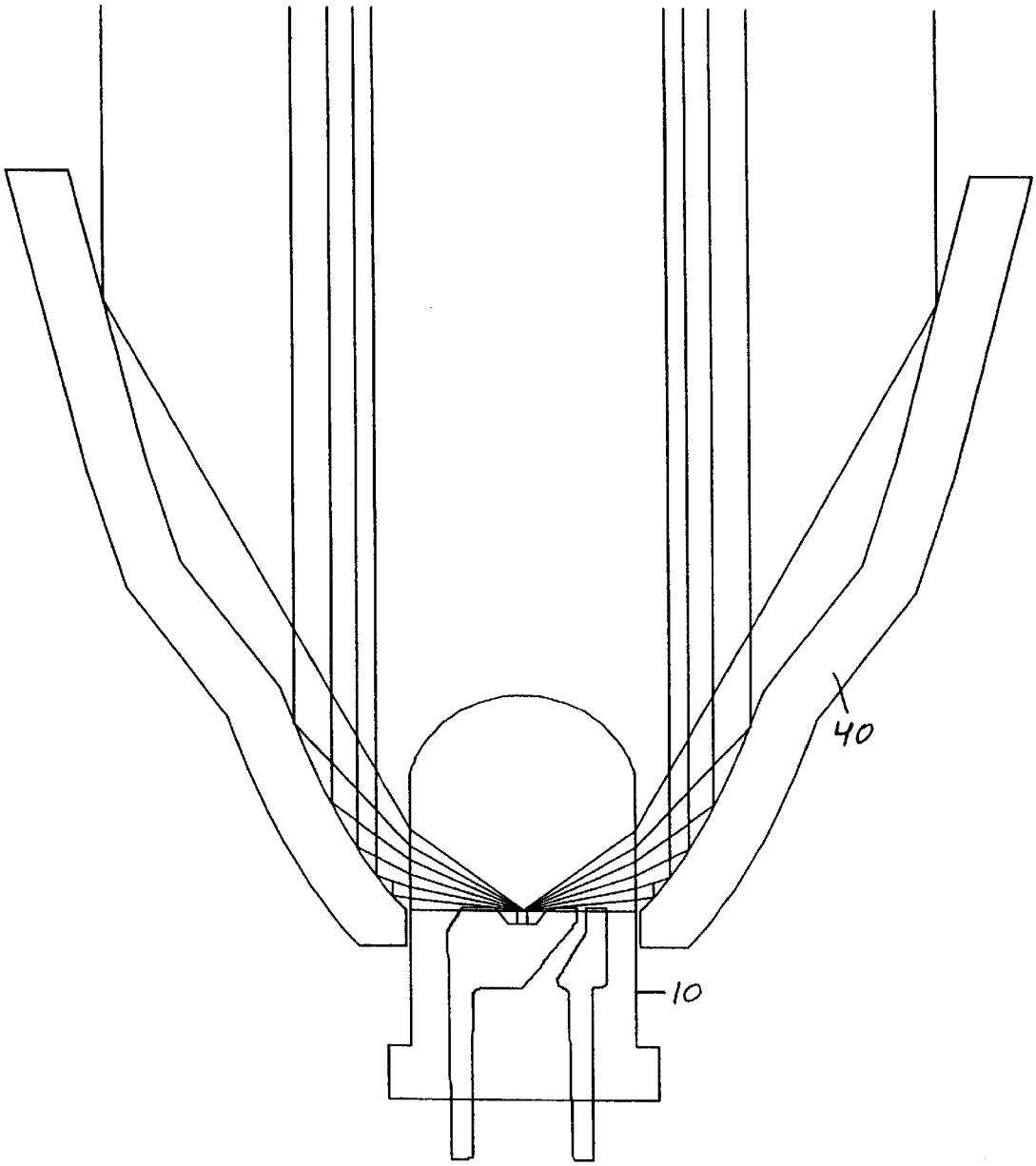
FIG. 7 is a light diagram showing the effect of the reflector of FIG. 6 upon the side emitted light component of an LED.
Figure 8:
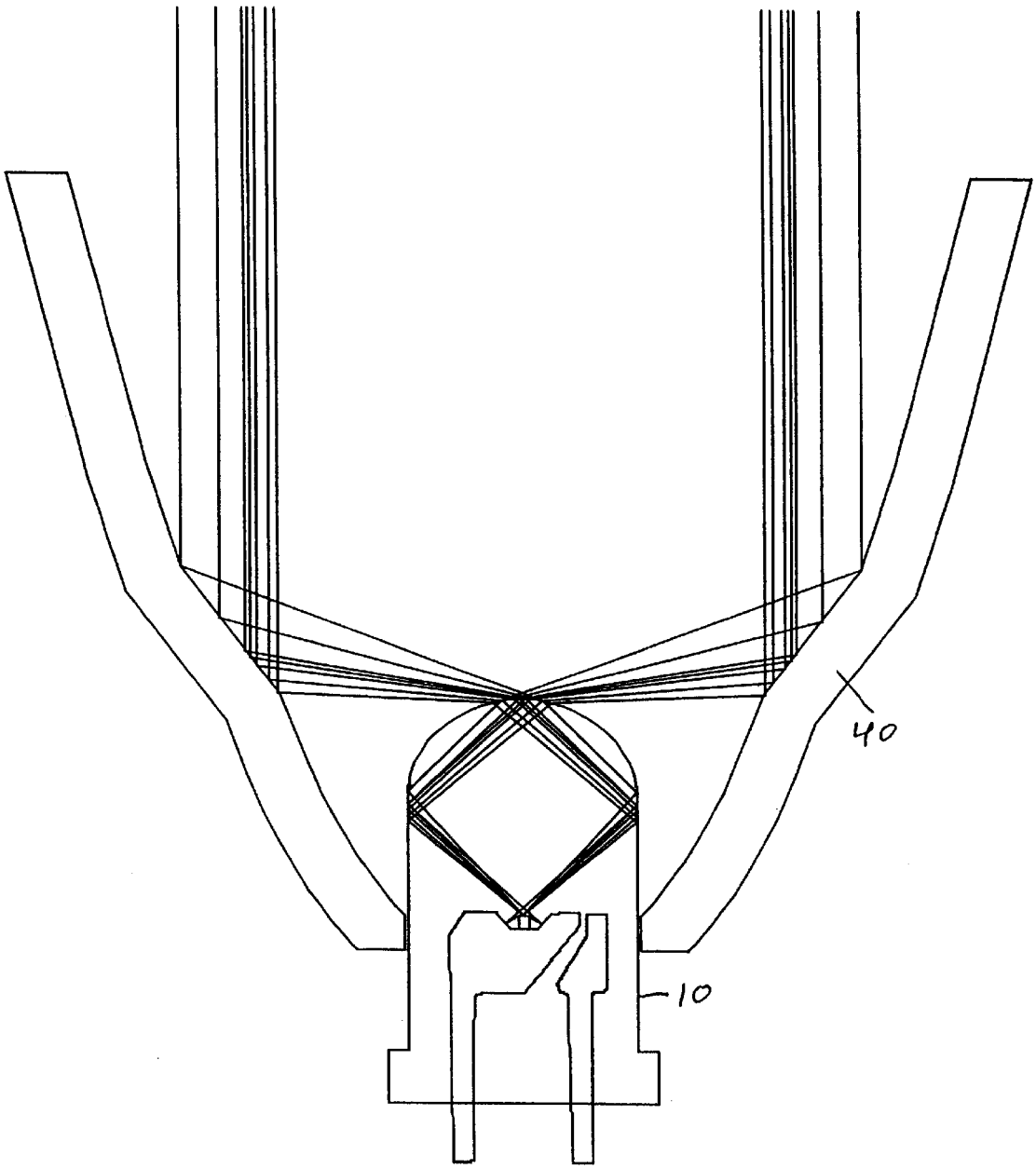
FIG. 8 is a light diagram showing the effect of the reflector of FIG. 6 upon the total internal reflection component of an LED.

As shown in FIGS. 7 and 8, the reflector 40 intercepts and redirects the light rays into a forward direction. The angles of the reflector surfaces 50*a*, 60, and 50*b* with respect to a vertical axis of the LED are selected to create a generally collimated or generally spreading light pattern as desired for the intended application. By modifying the mounting height of the reflector 40 with respect to the LED housing 10, a range of light patterns ranging from generally collimated to varying degrees of opened or closed light spread may be obtained from a single reflector embodiment.

When the reflector is configured with pairs of LEDs associated with each other as shown in FIG. 9 an oval light pattern is created. Traffic signals according to ITE specifications benefit from an initial oval light pattern created by the reflector, requiring less optical shaping of the light pattern in further optics of the signal.

Traffic signals are also required to minimize sun phantom effect. Large reflector matrixes 41 for traffic signals, for example as shown in FIG. 12 create a large reflective surface upon which undesirable reflections may occur. Previously, non reflector surfaces of reflectors have been masked or coated to reduce these reflections. By forming a deflector pattern 70, for example as shown in FIG. 11, on the non-reflector surfaces of each reflector and any areas between reflectors any extraneous light entering the traffic signal will be deflected away from the light pattern rather than reflected into it, creating undesired sun phantom effects. The deflector pattern 70 redirects the light, via for example 45 degree corrugations. By forming the deflector pattern 70 integral with the reflector, the extra step and cost of masking or coating the reflector may be avoided and the entire front facing reflector surface given a single reflective coating/finish.

Figure 13:
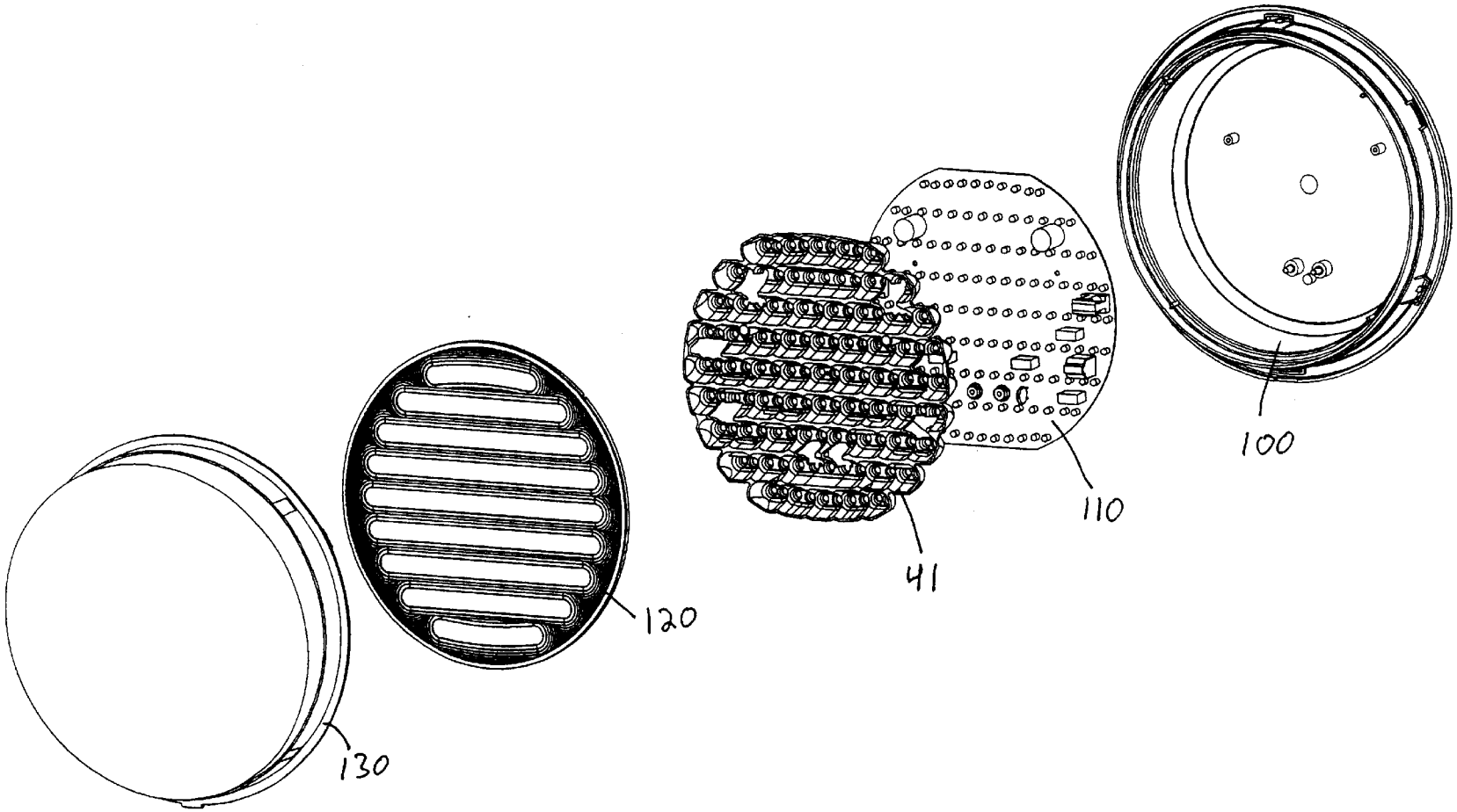
FIG. 13 is an exploded isometric view of a traffic signal embodiment of the invention.
Figure 14:
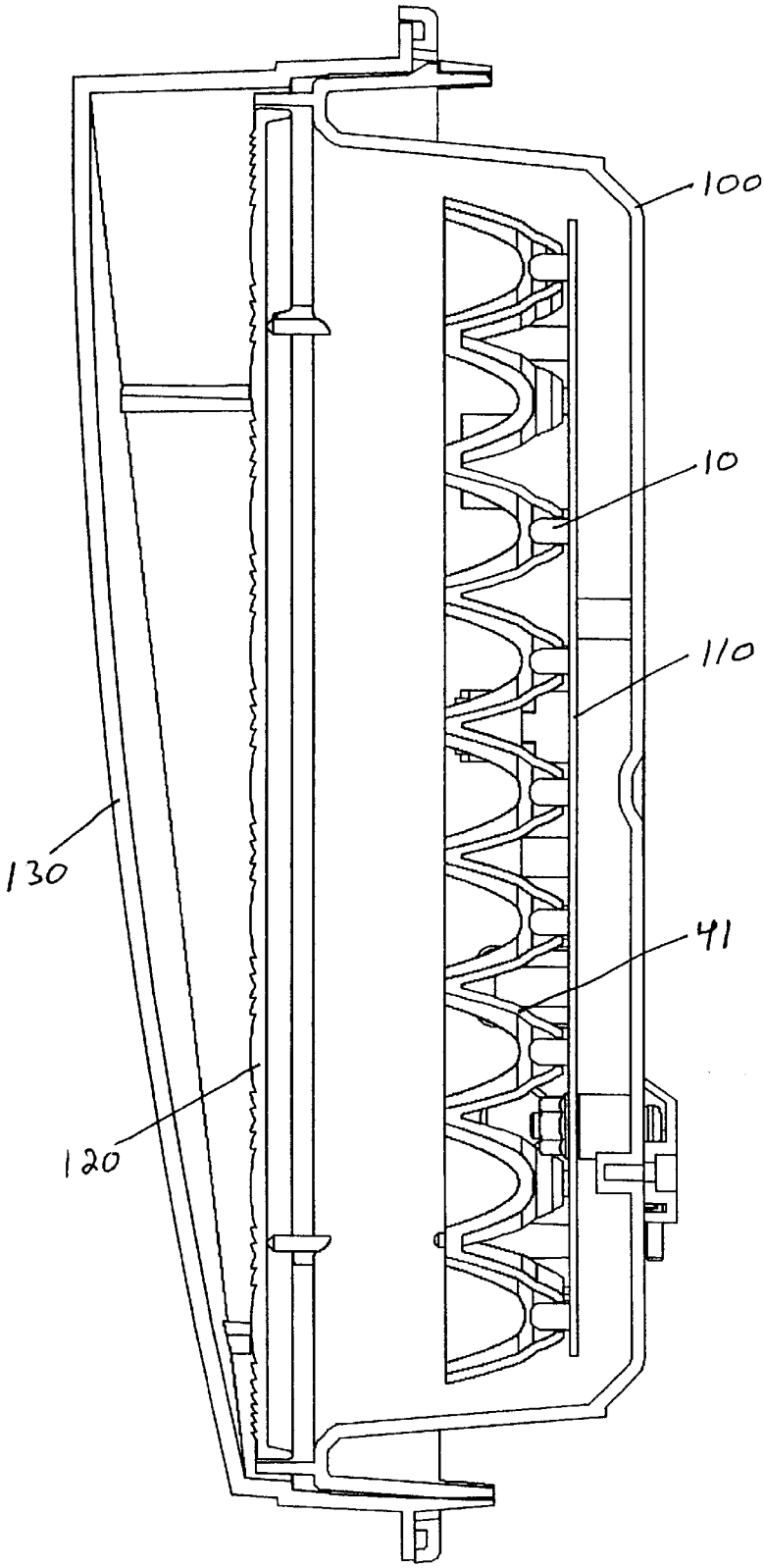
FIG. 14 is a cutaway side view of the traffic signal embodiment of FIG. 13.

A traffic signal embodiment of the invention is shown in FIGS. 13 and 14. A housing 100 contains a PCB 110 with a matrix of LEDs and a power supply circuit thereon. The reflector matrix 41 fits around the LEDs and has holes 80 for oversize electrical components and/or heat dissipation. An optical element 120 may be used along with optical features in the distribution cover 130 to create the desired light pattern.

The reflector may be mounted to the PCB via screws, posts or one or more support legs. The support legs allowing a snap connection to the printed circuit board (PCB) or heat sink that the LED(s) are mounted on.

The invention has been described with respect to LEDs. However, the invention is usable with any form of light emitting device, especially those with integrated housings that may create extraneous light emission patterns causing a design loss that may be corrected and utilized via the invention. The invention is entitled to a range of equivalents and is to be limited only by the scope of the following claims.

I claim:

1. A reflector use for with at least one LED, comprising:

a first reflector surface arranged to reflect a first light ray emitted by the LED through a side wall of the LED into a forward direction, abutting a second reflector surface arranged to reflect a second light ray emitted by the LED, after refraction by total internal reflection within a housing of the LED, into a forward direction, abutting a third reflector surface arranged to reflect a third light ray emitted by the LED through the side wall of the LED into a forward direction.

2. The reflector of claim 1, wherein:

the first reflector surface has a parabolic shape.

3. The reflector of claim 1, wherein:

the forward direction is generally parallel to a vertical axis of the housing of the LED.

4. The reflector of claim 1, wherein:

the forward direction is a generally spreading conical pattern about a vertical axis of the housing of the LED.

5. The reflector of claim 1, wherein:

the reflector is a plastic material with a reflective coating thereon.

6. The reflector of claim 1, wherein:

the reflector is metal with one of a reflective coating and a reflective finish.

7. The reflector of claim 1, wherein:

the at least one LED is two LEDs;

the LED's each having a separate first reflector surface;

the LED's sharing the second and the third reflector surfaces in common.

8. The reflector of claim 1, wherein:

the at least one LED is two LEDs;

the LED's each having a separate first and second reflector surface;

the LED's sharing third reflector surface in common.

9. The reflector of claim 1, wherein:

the at least one LED is a plurality of LEDs;

an area between reflector surfaces having a deflector pattern.

10. The reflector of claim 1, wherein:

the at least one LED is a plurality of LEDs;

the LED's aligned in a matrix of paired reflectors, the matrix of paired reflectors, having a separate first reflective surface for each of the plurality of LEDs, the LED's sharing the second and third reflective surfaces in common.

11. The reflector of claim 10, wherein:

a deflector surface is formed on a non reflector area between the paired reflectors and on a non-reflector area between LEDs in each paired reflector.

12. The reflector of claim 1, wherein:

a plurality of the reflectors are formed as a single assembly.

13. The reflector of claim 1, further including:

at least one support leg.

14. The reflector of claim 12, wherein:

the assembly has at least one aperture arranged to accommodate electrical components other than the at least one LED.

15. An LED signal, comprising:

at least one LED, a reflector having a first reflector surface arranged to reflect a first light ray emitted by the at least one LED through a side wall of the LED into a forward direction, abutting a second reflector surface arranged to reflect a second light ray emitted by the at least one LED, after refraction by total internal reflection within a housing of the at least one LED, into a forward direction, abutting a third reflector surface arranged to reflect a third light ray emitted by the at least one LED through the side wall of the LED into a forward direction; the reflector and the at least one LED attached to a pcb mounted in an internal area of a housing, the housing closed by a distribution cover.

16. The signal of claim 15, further including:

an optical element located between the reflector and the distribution cover.

17. The signal of claim 15, further including:

a power supply circuit located on a side of the PCB facing the distribution cover.

18. The signal of claim 17, further including:

an aperture formed in the reflector to accommodate an electrical component of the power supply circuit.

19. The signal of claim 15, further including:

a deflector pattern on a non reflector surface of the reflector.

20. The signal of claim 15, wherein:

the reflector is metal.

* * * * *